United States Patent [19]

Stover et al.

[11] 4,182,613

[45] Jan. 8, 1980

[54] COMPATIBILITY ADDITIVE FOR FUEL OIL BLENDS

[75] Inventors: William H. Stover, Sombra; Samuel A. Hunter, Bright's Grove, both of Canada

[73] Assignee: Exxon Research & Engineering Co., Florham Park, N.J.

[21] Appl. No.: 744,639

[22] Filed: Nov. 24, 1976

[51] Int. Cl.[2] ..... C10L 1/32

[52] U.S. Cl. ..... 44/51; 44/76

[58] Field of Search ..... 44/76, 51

[56] References Cited

U.S. PATENT DOCUMENTS 2,296,069 9/1942 Talbert et al. ..... 44/76

*Primary Examiner*—Winston A. Douglas
*Assistant Examiner*—Y. Harris-Smith
*Attorney, Agent, or Firm*—Roland A. Dexter; Frank T. Johmann

[57] ABSTRACT

Petroleum fuel compositions having a kinematic viscosity ranging from about 40 Saybolt Seconds Universal at 38° C. to about 300 Saybolt Seconds Furol at 50° C., e.g. residual fuel oils of grade numbers 4, 5 and 6, which contain dispersed sedimentary asphaltic constituents are stabilized against sedimentation of said constituents by the addition of a minor but sediment-stabilizing proportion of an alkylaryl sulfonic acid having from about 10 to 70 carbons for example, $C_{28}$–$C_{32}$ monoalkyl benzene sulfonic acid. The sediment-stabilizing property of the alkylaryl sulfonic acid is particularly useful for blends of distillate petroleum fractions and residua (includes reduced crude) wherein said blend contains from about 5 to about 15 weight percent of residua, based on the total weight of said blend.

7 Claims, No Drawings

COMPATIBILITY ADDITIVE FOR FUEL OIL BLENDS

BACKGROUND OF THE INVENTION

This invention relates to improved residual petroleum fuel oil compositions and to a method of preparing the same. More particularly, this invention deals with the control of dispersed sedimentary asphaltic constituents, such as asphaltenes and carbenes that can precipitate from residual fuel oils and is particularly concerned with the stabilization of intermediate fuels which are blends of distillate and residual fractions from crude processing.

Various types of instability may be exhibited by residual fuel oils. Among these are: (1) separation of asphaltic or carbonaceous matter, sludge, dirt and water during storage at normal temperatures; (2) separation of black waxy material during storage at low temperatures; (3) increase in viscosity during storage at normal temperatures; and (4) incompatibility or separation of insoluble matter on mixing of fuel oils from different sources. Although the commercially available fuel oils may vary widely in their tendency toward any of the above types of instability all may show some evidence of such instability.

Most present-day residual and intermediate fuel oils contain heavy asphaltic stocks in widely varying proportions. There is some evidence that certain constituents of these asphaltic stocks such as asphaltenes, carbenes, and the like are colloidal in nature and thus blends containing such stocks would not be expected to form true solutions in all cases. Rather, some constituents would be dispersed in the blend and might separate under certain conditions of storage and use.

In the past, the precipitation of asphaltenes and resins from residual, i.e. residuum containing, fuels has been largely avoided by proper selection of blending components. Only distillate and residuum from the same or similar crudes were mixed so there was less likelihood of colloid destruction through changes in solvency. In addition, the severity of reduced crude processing (cracking, distillation, desulfurizing) was controlled to a level that produced distillate and residuum which, on reblending, provided compatible fuels. However, as crude availability tightened due to depletion of reserves and changes in political climate, and also as the need increased to process certain component fractions more severely to reduce sulfur levels, the refiner lost flexibility. It became increasingly difficult to make components that would ensure compatible blends, particularly those also meeting low sulfur specifications.

On occasion, fuel blends are prepared in refineries that inadvertently form precipitates in excess of specification. Ways must then be found to dispose of these blends, such as by "blending-off", reprocessing or post treatment with an additive that will resuspend the material that has precipitated in a form that will not clog the filters, nozzles, etc., of a combustion system.

Additives of the detergent or dispersant type that are added to hydrocarbon fuels to control sludge separation are sometimes claimed to stabilize fuels against asphaltic constituent separation. However, most of them are either ineffective or only marginally effective at practical treating levels, especially for 'low sulfur' intermediate fuels. Structurally, these additives are usually metal salts of alkylarylsulfonic acids (see U.S. Pat. No. 2,888,338) or complex ashless dispersants containing amine, imide, ester, or hydroxyl type polar functionality attached to an oil-soluble hydrocarbon chain (see Canadian Pat. No. 605,449 and U.S. Pat. No. 2,958,590).

Oil-soluble sulfonate additives have been taught to be useful for stabilization against oxidative deterioration (not sedimentation of asphaltic constituents) of middle distillate petroleum fuel oil compositions (see Canadian Pat. No. 607,389 and U.S. Pat. No. 2,923,611).

Precipitation of asphaltenes is most likely to occur when the blended fuel is not sufficiently aromatic or naphthenic to provide adequate solvency. The tendency towards separation, therefore, increases with paraffinicity which is particularly serious with low sulfur fuels, where the residual component is frequently only 5–15% of the blend and the distillate has been hydrogen treated to remove sulfur or derived from a low sulfur paraffinic crude, for such blended residual fuels, i.e. intermediate fuels, are very susceptible to colloid degradation and asphaltene sedimentation.

Having briefly described the asphaltene sediment formation problems of residual fuels, it is an object of this invention to afford compositions of this type that are particularly adapted to overcome and avoid these problems.

SUMMARY OF THE INVENTION

It has been discovered that certain alkylarylsulfonic acids will prevent or significantly reduce the amount of asphaltic sediment separating from intermediate (residuum containing) fuels made from incompatible components. Sulfonic acids with 10 to 70 total carbons in the alkyl group(s) and aromatic ring(s) are effective. Alkyl benzenes with 20 to 40 carbons in the side chain(s) are preferred. Optimally, a monoalkylbenzene with an average side chain carbon number of about 28–32 is used. The treat rate required depends on the amount of sediment or precipitate that would separate from the residual fuel if it were not treated with the additive. It is generally necessary for complete dispersion to add about 1.0 to 1.5 parts by weight of additive for 1 part by weight of sediment as measured in the Sediment by Hot Filtration (SHF) Test (reported in "Industrial and Engineering Chemistry", Vol. 10, No. 12, pp. 678–680 (1938) and briefly described later). Of particular importance is the fact that the additive not only has the capability to prevent sediment formation but also can resuspend sediment that has already formed in a fuel blend. Thus the objects of this invention are met by the provision of a petroleum fuel composition having a kinematic viscosity ranging from about 40 Saybolt Seconds Universal (SSU) at 38° C. to about 300 Saybolt Seconds Furol (SSF) at 50° C. comprising a residual fuel oil containing dispersed sedimentary asphaltic constituents and a minor but sediment-stabilizing proportion of an alkylarylsulfonic acid having 10 to 70 total carbons. The useful fuel composition of the invention thus involves a method of improving the stability of a fuel oil composition having a kinematic viscosity ranging from about 40 Saybolt Seconds Universal (SSU) at 38° C. to about 300 Saybolt Seconds Furol (SSF) at 50° C. and comprising a residual fuel oil containing dispersed sedimentary asphaltic constituents by adding an alkylarylsulfonic acid having 10 to 70 total carbons to said fuel oil in an amount sufficient to stabilize said asphaltic constituents whereby sedimentation is controlled to allow combustion of said composition.

DETAILED DESCRIPTION OF THE PRESENT INVENTION

The Residual Fuel Oil

The residual fuel oils, to which the present invention is applicable, are residua-containing oils such as straight residuum, vacuum distillate fuels such as flash distillate oils, vacuum bottoms, and various blends of such residua-containing oils with middle distillate, e.g., 150°-345° C. oils, particularly heavy gas oils, e.g. 260°-345° C. oils. Residua-containing oils are oils that contain residua from the distillation of crude oil or shale oil or mixtures thereof. They can also be residues obtained by thermal cracking or catalytic crackin processes. Generally, the residua, or residuum-containing fuel will contain about 5% to 100%, e.g. about 10 to 100% by weight of residuum, and will preferably have an initial boiling point above 315° C., most preferably above 345° C., at atmospheric pressure. If 100% residuum, the oil is generally designated as No. 6 fuel oil, Bunker C fuel oil, etc. Residual products usually have an extremely high viscosity and conventionally are blended with distillate oils to form lighter viscosity residuum containing fuels. The distillate oil can be a middle distillate fuel oil or a vacuum or flash-distillate oil. Vacuum fuel oils are frequently made by flash distillation and are then called flash distillates. Flash distillates are therefore those distillate fuels obtained by flash distillation at reduced pressure of the residue obtained from the distillation of crude oil at atmospheric pressure.

These residual fuel oils which are usefully stabilized against asphaltic constituent agglomeration and resultant sediment formation are normally sold against specifications such as that described in the "Standard Specification for Fuel Oils, ASTM Designation: D 396-75, 1975 Annual Book of ASTM Standards, Part 23, page 217". In this particular specification, six grades are described: Numbers 1, 2, 4, 5 (light) 5 (heavy) and 6. The first two are 'all-distillate' but the rest often contain residuum and could be subject to the problem of incompatibility. The main basis for separation of the grades is viscosity with No. 4 having a minimum kinematic viscosity of about 40 to 45 SSU at 38° C., No. 5 (light) has a minimum viscosity of about 150 SSU at 38° C., No. 5 (heavy) has a minimum viscosity of about 350 SSU at 38° C. and No. 6 (Bunker C) has a maximum viscosity of about 300 SSF at 50° C. Since Grades 4, 5 and 6 generally are residual fuels the viscosity of fuels responsive to the additives of the invention ranges from about 40 SSU at 38° C. to about 300 SSF at 50° C. All grades are also subject to water, sediment and flash specifications.

Frequently a sulfur specification ranging from 0.3 to about 1.5 wt. % sulfur is placed on residual fuels, especially those being used in areas of high population density because of environmental considerations. For this reason, blends of middle distillates and residuum are utilized as intermediate fuels. If the components used to make an intermediate fuel are incompatible there is likely to be a ratio of residuum to distillate where the amount of sediment formed is at a maximum. This is illustrated in the following tabulation:

| Wt % Pitch (Residuum) in Blend With Middle Distillate | 3 | 5 | 10 | 15 | 20 |
|---|---|---|---|---|---|
| Sediment by Hot Filtration, Wt % | 0.40 | 0.56 | 0.82 | 0.80 | 0.50 |

As the concentrations of pitch approaches zero, so does the amount of sediment filtered out of the blend in the SHF Test. In addition, as the pitch content increases above 20%, the sediment level generally again falls as the hydrocarbons in the heavier fraction solubilize the asphaltic constituents. However, it is frequently the blends with the greatest tendency to precipitate that are most in demand because of their limited sulfur contents.

It should not be construed from the above that low sulfur fuels, i.e. those containing from about 0.3 to about 1.5 wt. % sulfur, are the only ones that can benefit from treatment with this additive. Fuels of very different composition, if they are incompatible, benefit from use of the additive here described.

The Sediment by Hot Filtration Test referenced above is an analytical method developed to predict the tendency of a fuel oil to clog screens or nozzles of burners. Sediment in distillates and in residual fuels with viscosities not greater than 300 Saybolt Seconds Furol at 50° C. can be measured. A portion of the sample is placed in a jacketed filter and steam heated to about 95° C., and without dilution, filtered through an asbestos pad, with suction of about 250 mm. Hg. The sediment remaining on the pad after washing with a non-aromatic solvent such as a high boiling naphtha is reported as wt% to the nearest 0.01% for residual fuels (fuels containing residuum).

The Asphaltic Constituents

The heavy stock contains asphaltic constituents such as asphaltenes, carbenes and the like which are colloidal in nature. Asphaltenes are known to the art as the highly aromatic, high molecular weight constituents having typical properties as shown in U.S. Pat. No. 3,093,573. Asphaltenes are generally solid, insoluble in alkanes, and can be isolated by contacting an asphalt-bearing residuum with a solvent-precipitant, normally a liquid paraffin having 5 to 9 carbon atoms, preferably n-heptane, in a ratio by volume of generally at least 4 parts of solvent-precipitant per part of residuum. The precipitant causes the asphaltene fraction to precipitate out as a solid material which can be subsequently removed by filtration, centrifugation, etc. A detailed description of one method of recovering asphaltenes is given in U.S. Pat. No. 3,087,887. Asphaltenes prepared in this manner are usually characterized by the substantial lack of any aliphatic hydrocarbon soluble component. Such methods of removal are time consuming and costly so that stabilization is preferred; further, asphaltenes are known to reduce the pour point of residual fuels, see German DOS 2446829.

Alkylaryl Sulfonic Acid Additive

The alylaryl sulfonic acids useful as asphaltic sedimentation stabilizing additives generally have from 10 to 70, preferably 26 to 46, total carbons. The alkyl substituent or substituents preferably have 20 to 40, optimally 28 to 32, total carbons.

The sulfonic acids suitable for this application can be prepared by several techniques. They may be entirely synthetic or prepared by sulfonation of natural petroleum derived alkyl aromatics. An example of the latter would be the sulfonic acids from the sulfuric acid, sulfur trioxide and the like treatment of petroleum fractions.

Acids of this type which are particularly useful possess molecular weights within the range of 300 to 650, preferably about 450 to 550.

Suitable alkylaromatics for subsequent sulfonation can be synthesized by several techniques. For example, benzene, toluene, naphthalene or phenol can be alkylated with an olefinic fraction or a chlorinated paraffin using a Friedel-Crafts catalyst. The olefins in turn may be produced by oligomerization of ethylene, propylene, higher alpha-olefins or isobutylene using appropriate catalyst systems. Waxy paraffinic fractions can be chlorinated to a suitable level, e.g. one or more Cl atoms per molecule and subsequently reacted with an aromatic using $AlCl_3$ as the catalyst. Other methods can also be used. The technique should in no way limit this invention.

Sulfonation may be conducted using any one of several reagents under appropriate conditions. Oleum, concentrated $H_2SO_4$, $SO_3$, $SO_3$ complexes and $ClSO_3H$ are examples. Probably 20% oleum and $SO_3$ are the most popular reagents and $SO_3$ the best for this application.

With oleum, the reagent, in a 5–15 wt% excess, would be added slowly to the alkylaromatics in a nonreactive hydrocarbon solvent with vigorous mixing and temperature control (about 25–35° C.). The majority of the unreacted sulfuric acid and sludge would then be separated using gravity settling after dilution with water. A water or water alcohol wash is then used to remove the last traces of sulfuric acid.

The alkylaromatic can be sulfonated with $SO_3$ swept into the system with a dry carrier gas. Again a nonreactive solvent would be employed to reduce viscosity and facilitate mixing. Alternately, the alkylaromatic can be sulfonated with liquid $SO_3$ dissolved in liquid $SO_2$.

Other suitable techniques are well documented in the literature on organic synthesis (e.g. Kirk-Othmer, *Encyclopedia of Chemical Technology,* Second Edition, Vol. 19, p. 291–301).

Thus, in summary a preferred class of sulfonic acids for use as additives according to this invention consists of monosulfonated alkylated mono- and/or bicyclic aromatic sulfonic acids which are formed by alkylating an aromatic nucleus and thereafter sulfonating the alkylated product. The alkyl group or groups of the alkylated mono- and bicyclic aromatic compounds average from 4 to 64, preferably from about 20 to about 40, total carbons and the group or groups may be straight chain and/or branched in structure. The preferred sulfonic acids for use in the invention are ones that are derived from sulfonation of mono-, di-, and trialkyl substituted benzene or naphthalene. Compounds that are especially preferred for sulfonation to the corresponding sulfonic acids are those having the structure

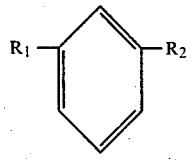

wherein $R_1$ is a hydrogen atom or an alkyl group that contains from 1–14 carbon atoms and $R_2$ is an alkyl group containing from about 14–36 carbon atoms. It will be noted that an alkylated naphthalene may be substituted for the alkylated benzene shown in the above structure. It is further preferred that the average number of carbon atoms among the alkyl groups of the alkylated mono- and bicyclic compounds illustrated above be about 20–40 and optimally about 28–32. Thus, specific examples of alkylated aromatic compounds of this type include tetradecyl benzene, hexadecyl benzene, eicosyl benzene, tetracosyl benzene, dotriacosyl benzene, etc. An especially preferred alkylated monocyclic aryl sulfonic acid is the sulfonic acid of octacosyl benzene.

Especially preferred alkyl mono-aryl sulfonic acids are those acids that are formed by alkylating benzene with oligomers of propylene or $C_4$–$C_{10}$ 1-alkenes and thereafter sulfonating the resulting alkylate. The class of compounds may thus be identified as the polyalkyl benzene sulfonic acids. Insofar as the present invention is concerned, the compounds of this type that are of special interest are the compounds where the alkyl groups are derived from olefin polymers and contain from about 20 to about 40 carbon atoms each and especially about 28 to 32 carbon atoms and especially preferred compound of this type used in the present invention is the octacosyl benzene sulfonic acid wherein the alkyl radical is derived from a nominal 28 carbon propylene oligomer.

The Final Fuel Composition

The preparation of the fuel oil compositions of the present invention involves no special technique. Generally, the compositions are formed by adding the oil-soluble stabilization additive to the heated residual fuel oil having a temperature of about 90° C. or higher, and stirring or agitating the composition until the additive is dissolved.

As noted, the alkylaryl sulfonic acid additive is readily oil soluble. However, sufficient mixing and heating must sometimes be provided to overcome viscosity effects in its direct addition to the residual fuel. Alternately, the additive can be diluted in a suitable solvent, e.g. a low grade distillate fraction, to provide a concentrate and reduce the viscosity for easier handling and application. Other useful solvents include, among others, mineral oils, hexane, heptane and the like.

If incompatibility of the residuum and distillate fractions is expected upon blending and the additive is being used to prevent it, incorporation could be conducted by in-line blending or premixing with any one of the fuel components. Mixing with the residuum fraction is particularly effective.

If the fuel has already been blended and precipitation has occurred, the fuel can be reclaimed by uniform admixture of the additive into the fuel. In-line blending in a pump-around or addition of the additive to the tank in a solvent followed by mechanical mixing or gas sparging are known accepted techniques for such uniform admixture.

The amount of additive required for stabilization of the asphaltic constituents is directly related to the concentration of the latter. Clearly the minimum amount is a small (minor) but sediment stabilizing amount readily ascertained through experimentation. Generally, it is useful to add from 50 to 250% of additive based on the weight of the sediment obtained as a result of the SHF Test; however, it is preferred that the addition range from about 100 to 150% with an additive treat for complete dispersion in excess of 1.5 parts/part of sediment as measured in the SHF test. Usually based by correlation of said SHF test results with field experience, a treat of 1.5% of the additive in the fuel would be more than adequate for essentially all applications.

The following examples are given by way of illustration to further explain the principles of the invention. These examples are merely illustrative and are not to be understood as limiting the scope and underlying the principles of the invention in any way. All percentages referred to herein are by weight unless otherwise specifically indicated.

EXAMPLE 1

Propylene was polymerized to a nominal 28 carbon number average olefin fraction using a boron trifluoride/water catalyst system of the type described in U.K. Pat. No. 1,148,966. The carbon number range was approximately 21 to 36. Benzene in greater than a 5 molar excess was then alkylated with the olefin using an $AlCl_3$/HCl Friedel-Crafts catalyst. The unreacted benzene and light degradation products were removed by atmospheric and vacuum distillation, leaving a product that was about 85 percent monoalkylated benzene with a carbon number distribution essentially the same as the starting olefin. The remainder of the product was mainly dialkylate and monoalkylate from dimerized olefins.

The alkylated benzene and $SO_3$ (about 1.1 mole/average mole of aromatic) dissolved in $SO_2$ were simultaneously added to a stirred reactor and sulfonated at −9° C. The $SO_2$ was then stripped from the sulfonation mass in a film evaporator at atmospheric pressure and a 90° C. wall temperature. An equal volume of hexane was added and the sulfonation sludge allowed to settle over 10 hours. The separated hexane solution was then washed with concentrated aqueous HCl. Finally, the hexane, residual water and HCl were stripped from the purified acid, first at atmospheric pressure to 90° C. and then under 100 mm. Hg vacuum at 110° to 120° C. The product was a dark brown viscous liquid containing about 90 wt.% $C_{28(ave)}$ alkylated benzene sulfonic acid.

EXAMPLE 2

An alkylbenzene sulfonic acid was prepared in a manner similar to that described in Example 1, except that the average carbon number of the side chain was 24 rather than 28. The product was a dark brown viscous liquid containing about 90 wt.% $C_{24(ave)}$ alkyl substituted benzene sulfonic acid.

EXAMPLE 3

The products of Examples 1 and 2, hereinafter designated as Additives 1 and 2, respectively, were then used to treat three low sulfur intermediate fuels which, without treatment, gave unacceptable levels of sediment as measured in the SHF test described earlier. An intermediate fuel is a residual fuel oil wherein distillate fractions such as light vacuum gas oils, heavy vacuum gas oils, heavy atmospheric gas oils, range oil, etc., are blended with a minor amount of residual stock. Such low sulfur intermediate fuels generally contain from about 0.3 to 1.5 wt. % sulfur. The results are shown in the following Table 1.

TABLE 1

Control of Asphaltene Separation With Additives 1 and 2

| Fuel Composition, LV% | | | | | | | | |
|---|---|---|---|---|---|---|---|---|
| Pitch | | Distillate | | | Sulfur | Adt. 1 | Adt. 2 | SHF[6] |
| A[1] | B[2] | LVGO[3] | HVGO[4] | HAGO[5] | Wt % | Wt % | Wt % | Wt % |
| 10 | — | 90 | — | — | 0.5 | 0.0 | 0 | 0.82 |
| 10 | — | 90 | — | — | 0.5 | 0.5 | 0 | 0.09 |
| 10 | — | 90 | — | — | 0.5 | 0 | 0.5 | 0.53 |
| 25 | — | — | 75 | — | 1.0 | 0.0 | 0 | 1.04 |
| 25 | — | — | 75 | — | 1.0 | 1.0 | 0 | 0.01 |
| 25 | — | — | 75 | — | 1.0 | 0 | 1.0 | 0.24 |
| — | 10 | — | — | 90 | 0.5 | 0 | 0 | 1.01 |
| — | 10 | — | — | 90 | 0.5 | 0.6 | 0 | 0.31 |
| — | 10 | — | — | 90 | 0.5 | 0.8 | 0 | 0.20 |
| — | 10 | — | — | 90 | 0.5 | 0 | 1.0 | 0.25 |
| — | 10 | — | — | 90 | 0.5 | 0 | 1.3 | 0.19 |
| — | 10 | — | — | 90 | 0.5 | 0 | 1.5 | 0.08 |

[1]Pitch A is the residuum from the distillation of a South American crude (Guanipa).
[2]Pitch B is a visbroken pitch from a typical Venezuelan crude.
[3]LVGO is Light Vacuum Gas Oil having a boiling range of about 238° C. to 343° C.
[4]HVGO is Heavy Vacuum Gas Oil having a boiling range of about 199° to 393° C.
[5]HAGO is Heavy Atmospheric Gas oil having a boiling range of about 249°-371° C.
[6]Sediment by Hot Filtration; a level of 0.15 wt % or less is acceptable for most applications.

In all cases Additive 1 reduced the level of sediment significantly when used at concentrations of 0.5 to 1.0 wt. % whereas Additive 2, while effective, had to be used at higher concentrations for the same improvement obtained with Additive 1.

EXAMPLE 4

Alkylbenzene sulfonic acids were prepared using three different olefins and the same general alkylation procedure described in Example 1. The sulfonation was conducted in heptane solution (1:1 by vol). The $SO_3$ (10% molar excess) was swept into the vigorously stirred reactor in a carrier gas ($N_2$). Modest cooling was required to maintain the reaction temperature about 25° C. When the sulfonation was complete, the hexane was removed by atmospheric and vacuum stripping.

Two of the olefins were linear fractions available commercially from and made from ethylene using an alkyl metal growth and displacement process. The third was an oligomer of 1-decene made using a cationic polymerization catalyst ($AlCl_3$). It contained about 56 carbons on average based on a bromine number of 20.3.

The above sulfonic acids, some others that were available commercially, and those prepared in Examples 1 and 2 were compared using a blotter test to assess the effect of alkylbenzene structure on potency. The blotter test is a screening procedure devised to indicate the relative activity of additives used to stabilize residual fuel oils. The test fuel was an incompatible residual fuel. Components known to produce an incompatible intermediate fuel were used, i.e. a heavy atmospheric gas oil from Western Canadian crude and a residuum or "pitch" from a South American crude. The additive was dissolved in the gas oil and the pitch was then added so that the ratio of distillate to residuum was 90:10 by weight. The mixture was homogenized by heating to 82° C. with mild stirring. A drop of the treated fuel was then applied to a blotter spot test sheet. The latter is a commercially available uniform porosity adsorbent paper used throughout the petroleum industry to determine the relative amounts of insolubles in used crankcase oils. The drop spreads slowly on the paper, making a circle of ever increasing diameter. Development is complete in 3 to 4 hours. If the fuel is completely uniform, i.e. no asphaltenes and resins have precipitated, the circle is uniform and relatively light in color. However, if a heavy precipitate has formed, as would be the case for an untreated fuel sample, a 'spot' with a distinctly darker center core results. Within these limits, different levels of precipitation can be detected by visual comparison with the spot for an untreated fuel. Not only is the test able to detect whether an additive has the capability to control asphaltene precipitation, but, through correlation, it can also be used to detect the concentration of additive that is required to meet a specified level in the Sediment by Hot Filtration Test (SHF) described above.

Both the blotter and SHF tests showed that an alkylbenzene sulfonic acid with a preferred structure, i.e. Additive 2, reduced the sedimentation level with increased concentration as is illustrated in the following tabulation:

| | | | | |
|---|---|---|---|---|
| Additive 2, Treat, wt % | Nil | 1.0 | 1.3 | 1.5 |
| SHF, wt % | 1.01 | 0.25 | 0.19 | 0.08 |
| Blotter Test | black core | | | almost uniform |

The results of the blotter test with the several referenced sulfonic acids are set forth in Table 2.

TABLE 2

A Comparison of Sulfonic Acids in the Blotter Test

| | Toluene Suflonic Acid | Dodecyl Benzene Sulfonic Acid | Octadceyl Benzene Sulfonic Acid | Additive 2 | Additive Example 4 | Additive Example 4 | Additive 1 | Additive Example 4 |
|---|---|---|---|---|---|---|---|---|
| Alkylchain Source | — | — | — | propylene polymer | ethylene polymer | ethylene polymer | propylene polymer | decene polymer |
| Alkyl chain-carbon total number | 1 | 12–15 | 17–18 | 24 avg | 20–24 | 24–28 | 28 avg. | 56 avg. |
| Total acid Number Mg KOH/g | 325.5 | 124.3 | 177.9 | 110 | 194.1 | 198.6 | 127.4 | 74.6 |
| Blotter Test[1] Rating at | | | | | | | | |
| 0.5 wt % | 1 | 2 | 2 | 4 | 1 | 1 | 4 | 2 |
| 1.0 wt % | 1 | 2 | 3 | 6 | 3 | 3 | 9 | 2 |
| 1.5 wt % | 1 | 3 | 4 | 8 | 5 | 4 | 10 | 4 |
| 2.0 wt % | — | — | — | 10 | 8 | 8 | 10 | 8 |
| 3.0 wt % | — | — | — | 10 | 10 | 9 | 10 | 10 |

[1]Rating Scale: 1 = black core, essentially no dispersion 10 = complete dispersion; uniform spot color The 28 average alkyl carbon number propylene oligomer was the most effective followed by its twenty-four average homologue. The other products, for reasons not entirely obvious, were not as effective. It could be due to differences in chain length, chain structure or degree of sulfonation.

EXAMPLE 5

The following experiments were conducted to illustrate that a preferred sulfonic acid, i.e. Additive 2, could resuspend asphaltic material once it had precipitated as well as prevent sediment formation when added to one of the components prior to blending.

Incompatible fuel blends were prepared using 90 parts gas oil from Western Canadian crude and 10 parts pitch from South American. In one case, Additive 2 was added to the gas oil prior to blending and homogenization at 82° C. In the other, Additive 2 was added after blending and asphaltene separation. (The latter blend was heated to 82° C. for one hour before spot tests were conducted.) Treats of 1.0, 1.5 and 2.0 wt. % were employed.

The blotter tests showed equivalent levels of asphaltene dispersion at the same treat levels for both methods of addition.

Two sedimented incompatible blends were then treated with the additive. Changes in the level of sediment were measured using the hot filtration test. The results confirmed the effectiveness of the additive even on blends where precipitation had occurred much earlier. (See Table 3).

TABLE 3

Resuspension of Asphaltic Sediment With Additive 2

| Pitch Source | Fuel Sulfur Wt % | Additive 2 Treat Wt % | Original SHF, wt %[1] | SHF After Additive Treatment |
|---|---|---|---|---|
| Persian Gulf | 1.0 | 1.0 | 1.62 | 1.20 |
| Persian Gulf | 2.5 | 2.0 | 0.18 | 0.09 |
| Guanipa | 0.5 | 1.5 | 1.01 | 0.08 |
| " | 0.5 | 1.0 | 1.01 | 0.40 |

[1]Sediment by Hot Filtration

EXAMPLE 6

Blotter tests were conducted using the same procedure as in Example 4 on sulfonic acid salts derived from neutralization of Additive 2 to illustrate that it is the free acid that is effective.

TABLE 4

| Additive | Dispersion Rating at 1.5% Treat |
|---|---|
| Additive 2 | 8 |
| Salts of Additive 2 | |
| Calcium | 1 |
| Barium | 1 |
| Lithium | 2 |
| Ammonium | 2 |
| Pyridinium | 1 |
| Aniline | 1 |

[1]Rating Scale: 1 = black core, essentially no dispersion 10 = complete dispersion, uniform spot color The free sulfonic acid was dramatically more effective than the corresponding salts. This result is surprising and suggests the effectiveness of the acid may be due to chemical reaction with basic sites on the asphaltenes.

EXAMPLE 7

A series of organic acids other than sulfonic (mainly carboxylic) were screened in the blotter test as in Example 4 to determine whether acid type was important. Only the sulfonic was effective on the fuel of 90 parts Western Canadian gas oil and 10 parts South American pitch as seen in Table 5.

TABLE 5

| | Acid Type | Dispersion Rating[1] at 1.5% Treat |
|---|---|---|
| Additive 2 | Sulfonic | 8 |
| Dodecenylsuccinic Acid | Carboxylic | 1 |
| Octadecenylsuccinic Acid | Carboxylic | 2 |
| 950 mol wt polyisobutenylsuccinic Acid | " | 1 |
| Naphthenic Acid | " | 1 |
| $P_2S_5$ Treated 950 mol wt Polyisobutylene | Thio-phosphoric | 2 |

[1]Rating scale as in Table 4.

EXAMPLE 8

Several materials other than alkylaromatic were sulfonated and evaluated in the blotter test using the same procedure described in Example 7. The sulfonations were conducted in a vigorously stirred glass reactor. The material being sulfonated was diluted in 2 parts of n-heptane. The $SO_3$ was vaporized in a separate vessel and swept as a dilute mixture in nitrogen into the reaction flask. When the reaction was complete, the solvent was removed by nitrogen stripping to 93° C.

TABLE 6

| Product Sulfonated | Total Acid No. mg KOH/g | Dispersion Rating[1] at 1.5% Treat |
|---|---|---|
| Additive 2 | 110 | 8 |
| 950 mol wt polyisobutylene | 40.3 | 1 |
| 63500 mol wt ethylene/propylene copolymer (46% $C_2$) | 48.0 | 1 |
| Sulfonated styrene/butadiene Copolymer (Lubad 125)[3] | 77.5 | 1 |
| Guanipa Pitch | 24.2 | 1 |

[1]Rating scale as in Table 4.
[3]A viscosity index improver additive for lubricating oils sold by Lubrizol Corp., Cleveland, Ohio.

None of the above materials showed a significant level of activity relative to the alkylarylsulfonic acid Additive 2. Thus, there appear to be limits other than molecular weight on the hydrocarbon that, when sulfonated, provides product with the ability to keep asphaltic constituents in suspension.

EXAMPLE 9

A series of compounds commonly used as crankcase oil or fuel sludge dispersants were evaluated in the blotter test. The results set forth in Table 7 below illustrate that none were as effective as an additive of the invention. The fuel tested was the same 90:10 mixture of Western Canadian gas oil and South American pitch.

TABLE 7

| Product | Dispersant Rating[1] at 1.5% Treat |
|---|---|
| Additive 2 | 8 |
| A series of polyisobutenylsuccinimides resulting from the reaction of polyisobutenylsuccinic anhydride and a polyamine | 1–2 (ranged within) |
| Acryloid 954R[2] (Dispersant VI Improver) | 1 |
| Lubrizol 936[3] (Polyester Dispersant) | 6 |
| Lubrizol 949[3] (Dispersant) | 3 |

[1]Same rating scale as in Table 5.
[2]A dispersant-viscosity index improver for lubricating oil sold by Rohm & Haas of Philadelphia, Pa.
[3]A lubricating oil dispersant sold by Lubrizol Corp. of Cleveland, Ohio.

It is to be understood that the examples present in the foregoing specification are merely illustrative of this invention and are not intended to limit it in any manner, nor is the invention to be limited by any theory regarding its operability. The scope of the invention is to be determined by the appended claims.

What is claimed is:

1. A petroleum composition having a kinematic viscosity ranging from about 40 Saybolt Seconds Universal (SSU) at 38° C. to about 300 Saybolt Seconds Furol (SSF) at 50° C. comprising about 5 to 100 wt.% of residuum, said composition containing dispersed sedimentary asphaltic constituents, said fuel being a blend of fuels which tend to be incompatible whereby the blend tends to separate said asphaltic constituents as sediment in the Sediment by Hot Filtration (SHF) test, and a minor but sediment-stabilizing proportion of an alkylarylsulfonic acid which inhibits said sedimentation and having in the range of 10 to 70 total carbons.

2. A petroleum fuel composition according to claim 1 wherein said sulfonic acid is derived from an alkyl substituted benzene having from 20 to 40 total carbons in said alkyl substituent and is present in an amount ranging from 50 to 250% of the weight of said asphaltic constituents as determined by the Sediment by Hot Filtration (SHF) Test.

3. A petroleum fuel composition according to claim 2 wherein said sulfonic acid is a monoalkylbenzene sulfonic acid with from about 28 to 32 carbons in said alkyl substituent and is present in an amount ranging from about 100 to 150% of the weight of said constituents as determined by the sediment by Hot Filtration (SHF) Test.

4. An intermediate petroleum fuel composition according to claim 3 wherein said fuel contains about 5 to 15 weight proportions of residual fuel oil blended with from about 85 to 95 weight proportions of distillate fuel and contains from about 0.3 to 1.5 wt.% sulfur based on the total weight of said composition.

5. A method of improving the stability of a fuel oil composition having a kinematic viscosity ranging from about 40 Saybolt Seconds Universal (SSU) at 38° C. to about 300 Saybolt Seconds Furol (SSF) at 50° C. comprising a residual fuel oil containing dispersed sedimentary asphaltic constituents, said fuel being a blend of fuels which tend to be incompatible whereby the blend tends to separate said asphaltic constituents as sediment in the Sediment by Hot Filtration (SHF) test, by the step of adding an alkylaryl sulfonic acid stabilizer having in the range of 10 to 70 total carbons to said fuel oil in an amount sufficient to stabilize said asphaltic constituents whereby sedimentation is controlled.

6. A method according to claim 5 wherein said alkylaryl group has a molecular weight ranging from 300 to 650 and is represented by the structure

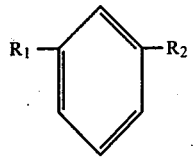

wherein $R_1$ is hydrogen or an alkyl group that contains 1–14 carbon atoms and $R_2$ is an alkyl group containing from about 14–36 carbon atoms.

7. A method according to claim 6 wherein from 1 to 1.5 parts by weight of the sulfonic acid of octacosyl (ave.) benzene is added to said fuel oil per 1 part by weight of asphaltic constituent as determined by the SHF Test.

* * * * *